US005630536A

United States Patent [19]

Bugnaski

[11] Patent Number: 5,630,536

[45] Date of Patent: May 20, 1997

[54] ADJUSTABLE BODY PACK

[76] Inventor: Mark S. Bugnaski, 7501 Shipley La., Kingsville, Md. 21087

[21] Appl. No.: 519,359

[22] Filed: Aug. 25, 1995

[51] Int. Cl.[6] ..... A45F 3/04

[52] U.S. Cl. ..... 224/600; 224/605; 224/627; 224/637; 224/648; 224/649; 224/259; 224/579

[58] Field of Search ..... 224/600, 603, 224/605, 625, 627, 637, 648, 649, 153, 259, 260, 215, 211, 240, 578, 579, 581–583, 674; 2/94, 95, 102

[56] References Cited

U.S. PATENT DOCUMENTS

| | | | |
|---|---|---|---|
| Re. 14,365 | 9/1917 | Danz, II | 224/637 |
| 469,444 | 2/1892 | Frazier | 224/674 |
| 1,542,163 | 12/1925 | Morde | 224/646 |
| 3,152,738 | 10/1964 | Worsfold, Jr. | 224/259 |
| 3,184,883 | 5/1965 | McCook | 224/639 |
| 3,583,600 | 6/1971 | Scott | 224/646 |
| 4,600,134 | 7/1986 | Colby | 224/260 |
| 5,024,360 | 6/1991 | Rodriguez | 224/637 |

*Primary Examiner*—Henry J. Recla
*Assistant Examiner*—Timothy L. Maust

[57] ABSTRACT

A carrying system which may be utilized for carrying video cameras, photography cameras and accessories, medical supplies, tools or recreational equipment therefor comprising two adjustable compartment bags that are each supported by an adjustable shoulder strap and an adjustable waist belt that when worn over the upper body provide a comfortable, balanced and accessible carrying system. Alternatively, both compartment bags may be re-configured and locked together to form a single shoulder bag.

4 Claims, 6 Drawing Sheets

ADJUSTABLE BODY PACK

BACKGROUND OF THE INVENTION

1. Field of Invention

This invention relates to devices used for carrying a large amount of equipment on a person's body, referring to backpacks, fanny packs and shoulder bags with multiple storage areas that are mounted or strapped onto or over the body. This invention provides the comfort and stability of a backpack the easy accessibility of a fanny pack, and increased flexibility with the way it is configured.

2. Description of the Prior Art

The United States Patent specification No. 4,884,731 discloses a backpack providing a pair of detachable auxiliary side packs. Each of the auxiliary side packs is connected to the main pack by multiple pairs of fasteners, and one fastener of each pair is connected to the main pack by adjustable strap. The adjustable straps can be tightened to adjust the capacity of the auxiliary packs. The drawback to this devices is that it must be removed from the wearer's back to access items.

The U.S. Pat. No. 5,219,423 discloses a carrying system which may be utilized for carrying video cameras and accessories therefor comprises a main case and a plurality of accessory cases which interlock for carrying as a single unit. The main case includes clasp for releasably engaging linking straps which are provided on the accessory case for locking the accessory case to the main case. The accessory case is provided with, in addition to the linking straps, clasp like those on the main case so that a plurality of accessory cases may be joined together. Further, slots are provided on a portion on the accessory case such that free ends of the linking straps may be retained when the accessory case is carried alone, and so that the accessory case may be looped through the belt, or shoulder strap of a user for convenient carrying. The drawback to this carrying system is that it rests the weight of its contents on one side of the body, and is not easily accessible.

SUMMARY OF THE INVENTION

It is therefore a principal object of the ADJUSTABLE BODY PACK to provide a carrying system for a variety of items by means of a comfortable wearing method that allows easy accessibility. This invention combines the advantages of a backpack with a fanny pack while allowing the wearer easy access to the pack's compartment bags without removing the carrying system, and provides flexibility in how the pack arrangement is configured. Furthermore, when this invention is used in its fullest capacity, the wearer is able to adjust how the weight is sustained and maintain better balance and freedom of movement.

BRIEF DESCRIPTION OF THE DRAWINGS

The present invention will be understood more fully from the detailed description given herebelow and from the accompanying drawings of the preferred embodiments of the invention. However, the drawings are not intended to imply limitation of the invention to a specific embodiment, but are for explanation and understanding only.

In the drawings.

DESCRIPTION OF THE PREFERRED EMBODIMENT

Figure 1:
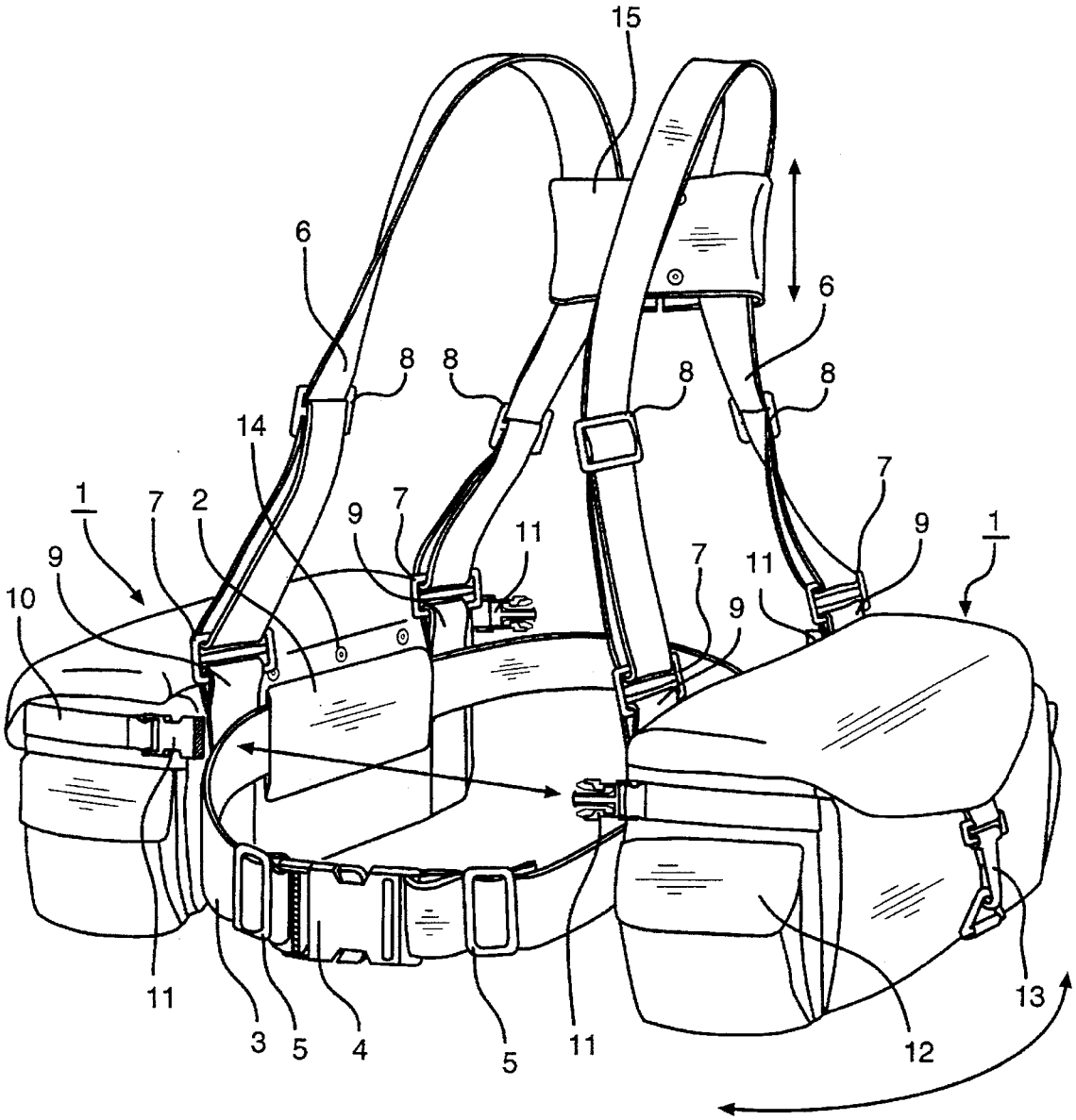
FIG. 1, shows a front perspective view of the carrying system of the invention opened into its fullest wearing capacity.

Referring now to the drawings, particularly to FIG. 1, the carrying system of the invention is comprised of a pair of compartment bags 1. Each compartment bag is provided with a belt loop or channel opening 2 located on the rear side. An approximate two-inch webbing waist belt 3 is fed through the compartment bag belt loops 2 which provide additional carrying support to the compartment bags 1 while enabling the carrier to freely slide and position the compartment bags 1 around the waist from front to back.

The webbing waist belt 3 is assembled closed with a male and female design acetal side release buckle 4 like those sold under the trademark ITW NEXUS and the webbing waist belt 3 is adjustable with two-inch acetal standard triglides 5 like those also sold under the trademark ITW NEXUS.

An approximate two-inch webbing is used to provide a shoulder strap 6 for each compartment bag 1 and are attached via a two-inch acetal standard triglide 7. The webbing shoulder straps are secured and are adjusted using acetal wide-mouth triglides 8 like those sold under the trademark ITW NEXUS. An approximate two-inch webbing 9 is sewn directly and vertically to both ends on the rear side of each compartment bag 1 to attach acetal standard triglides 7, and as illustrated, to attach the looped ends of the webbing shoulder straps 6 to the compartment bag 1.

Figure 2:
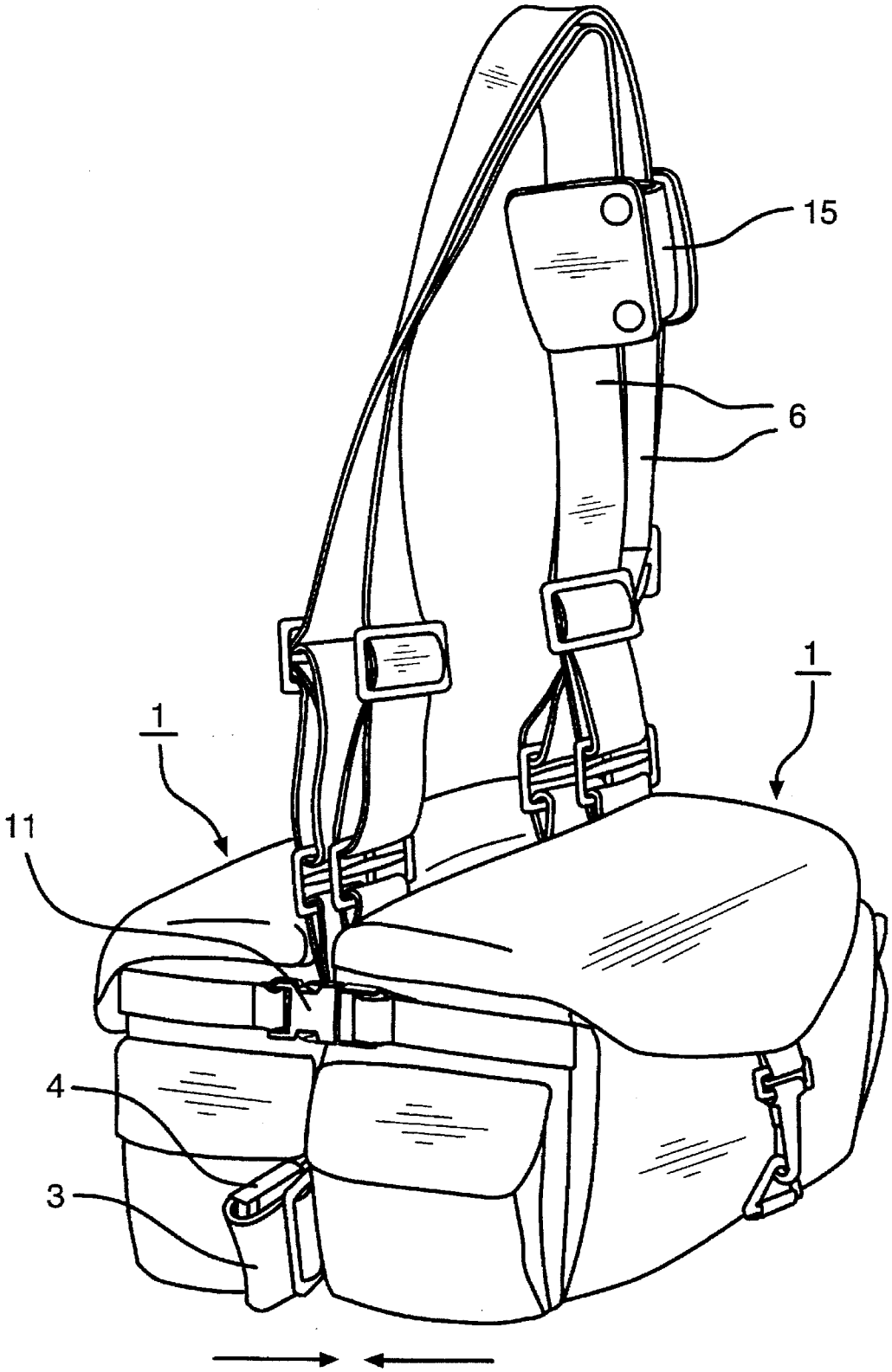
FIG. 2, shows the carrying system of FIG. 1, with its components joined together to configure a single shoulder carrying unit.

An approximate one-inch webbing 10 is sewn directly and horizontally at the top of both sides of each compartment bag 1 to attach an approximate one-inch female or male standard side release buckle component 11, like those sold under the trademark ITW NEXUS, as indicated. The standard side release buckle components 11 are used to fasten and lock the rear ends of both compartment bags 1 together as illustrated in FIG. 2, forming a single shoulder bag carrying device.

Figure 6:
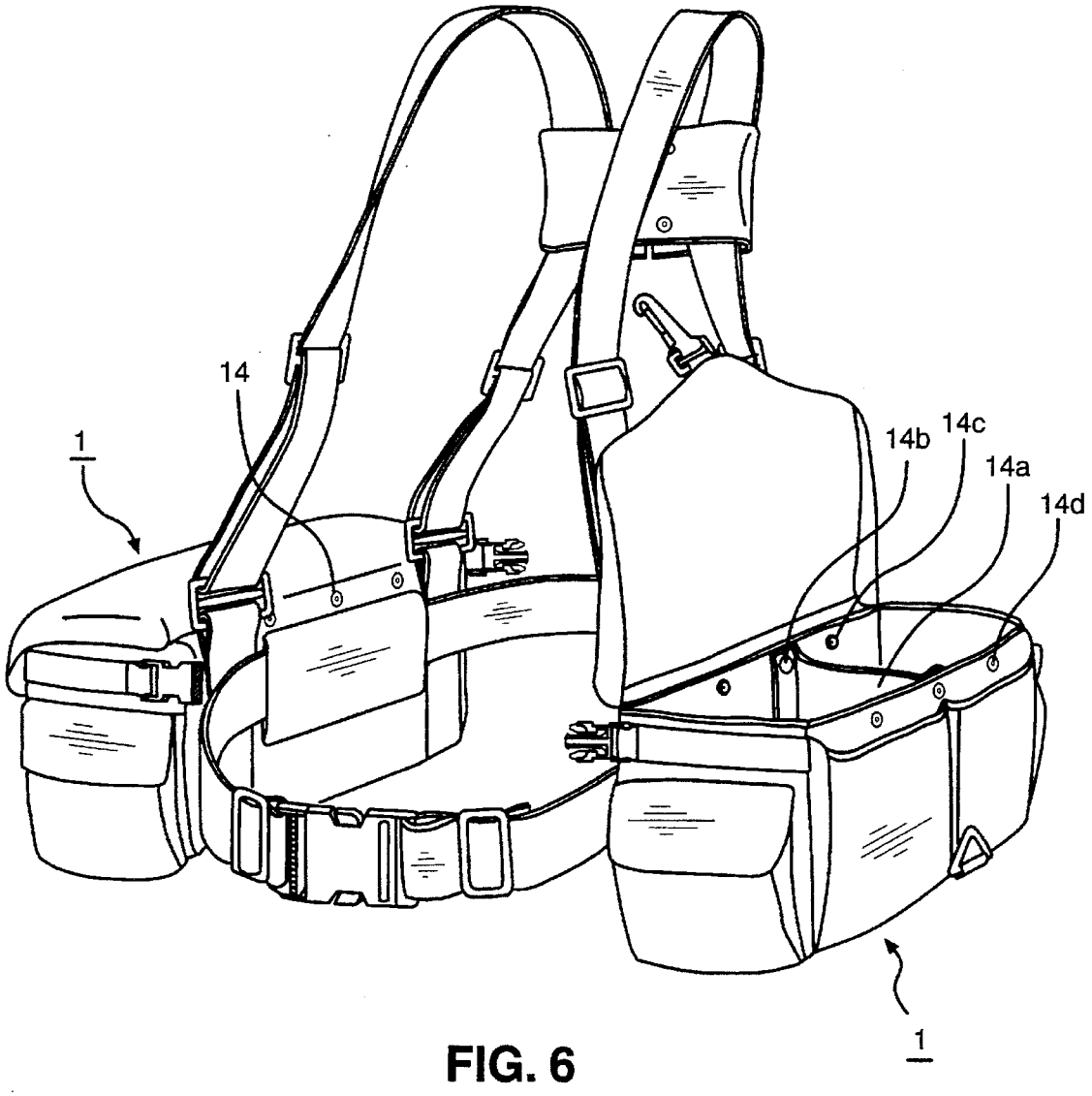
FIG. 6, shows an inside view of the compartment bag and the use of button snaps to position and secure partitions within the compartment bags.

Referring again to FIG. 1, each compartment bag 1 and its waist belt loop is constructed of durable natural or synthetic cloth. Both compartment bags 1 are of narrow rectangular shape with side pockets 12 attached to each side with flaps that close using hook and loop material as like that sold under the trademark VELCRO. Each bag's main compartment lid is provided with an interlocking snap hook and tri-ring assembly 13 to secure closure of the main compartment. A set of button snaps 14 are provided to position partitions inside each compartment bag 1. Referring now to FIG. 6, inside each compartment bag 1, a compartment partition 14*a* is secured in place by pressing a female button snap component 14*b* located at each top end of the compartment partition, onto a selected male button snap component 14*c*. Male button snap components 14*c* are provided along the top rear and front sides of both compartment bags 1 as indicated and are affixed with button snap rivets 14*d*.

Hook and loop material may also be provided to position the compartment partitions 14*a* inside the compartment bags 1 in lieu of or addition to button snaps 14.

Referring again to FIG. 1, an adjustable upper back flexible binding 15 is provided to position the adjustable webbing shoulder straps together at a point on the wearer's back just below the base of the neck when the carrying device is worn over the body.

Figure 3:
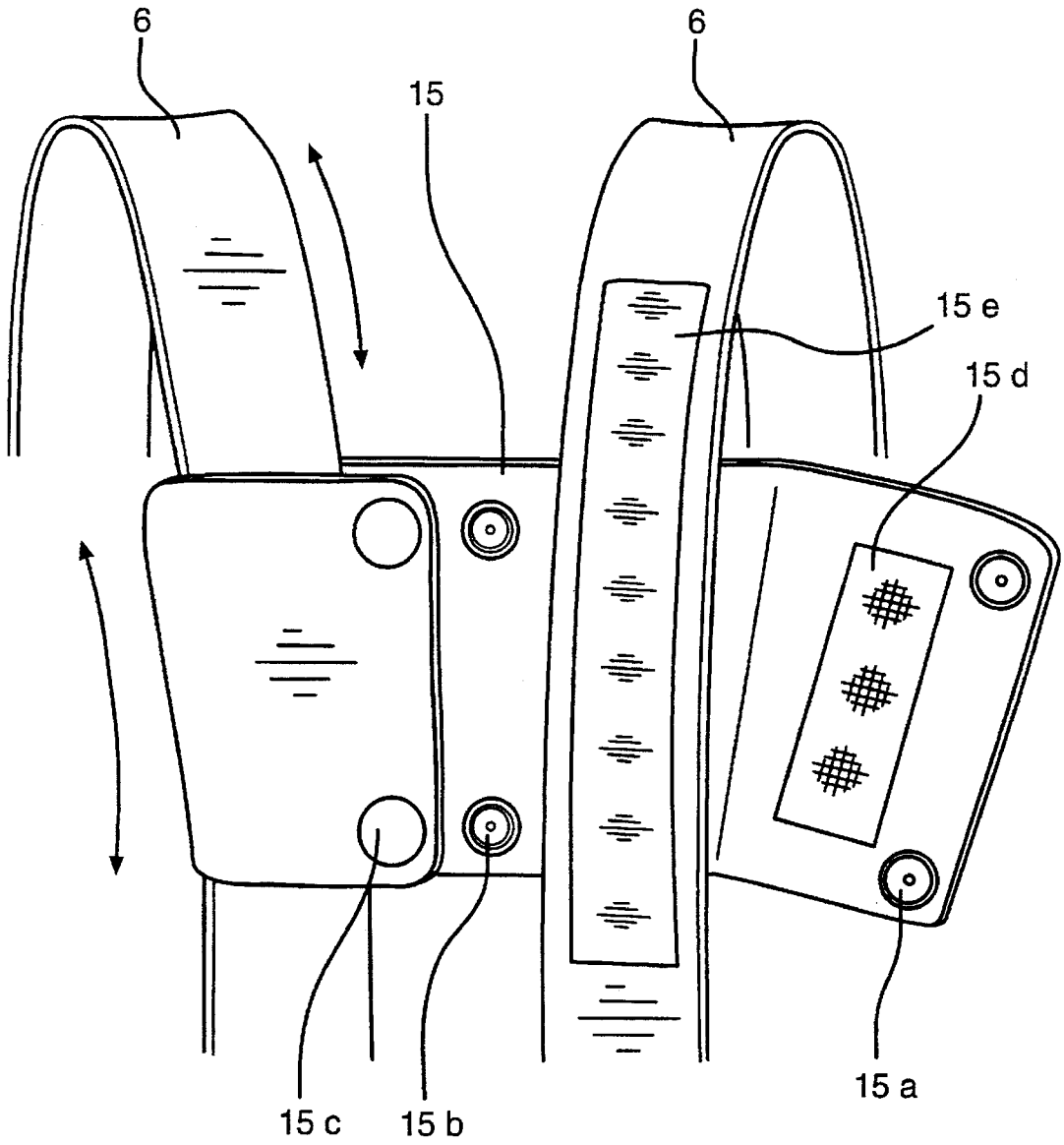
FIG. 3, shows a rear view of the adjustable upper back flexible binding with one side open to reveal the magic tape (velcro) construction for fixed positioning along the indicated shoulder strap.

Referring now to FIG. 3, the illustration shows the rear view of the adjustable upper back flexible binding and its components. The upper back flexible binding 15 is a thick, durable natural or synthetic cloth that wraps around each webbing shoulder strap 6. Both end flaps of the upper back flexible binding 15 are closed by connecting the female button snap component 15*a* with the male button snap component 15*b*, and firmly pressed together. Both end flaps of the upper back flexible binding 15 are provided with top and bottom button snaps 15*c*.

Only one side of the upper back flexible binding 15 (illustrated as the right side in FIG. 3) is provided with hook and loop material (VELCRO) 15*d* and to one shoulder strap 15e (also illustrated as the right shoulder strap 6 in FIG. 3) to secure and adjust the position of the upper back flexible binding. The other side of the upper back flexible binding (illustrated as the left side in FIG. 3) is simply wrapped around the other shoulder strap 6 (illustrated as the left shoulder strap in FIG. 3) providing a channel for the shoulder strap 6 to slide through and/or allowing the upper back flexible binding 15 to slide up or down the the free shoulder strap.

The configuration of the adjustable upper back flexible binding 15 in FIG. 3 provides the carrying system with the ability to adjust the position of each compartment bag 1 independently around the wearer's waist without jamming the shoulder straps 6, while still maintaining the position of both shoulder straps together at the wearer's upper back. The angle of the fold on the end flaps of the upper back flexible binding 15 direct the shoulder straps from the center of the wearer's back out over the shoulders respectively.

Referring again to FIG. 2, when the carrying system is configured together into a single shoulder bag, the upper back flexible binding 15 easily folds at the center between the left and right end flaps allowing the shoulder straps 6 to position under and over each other forming a single shoulder strap. Furthermore, the carrying system's webbing waist belt 3 conveniently folds between the rear sides of the locked compartment bags. It is only necessary to lock the compartment bags together at the top as illustrated with the approximate one-inch side-release buckle assembly 11, for the weight of objects carried inside the compartment bags 1 will hold the bottom of each compartment bag 1 together naturally.

Figure 4:
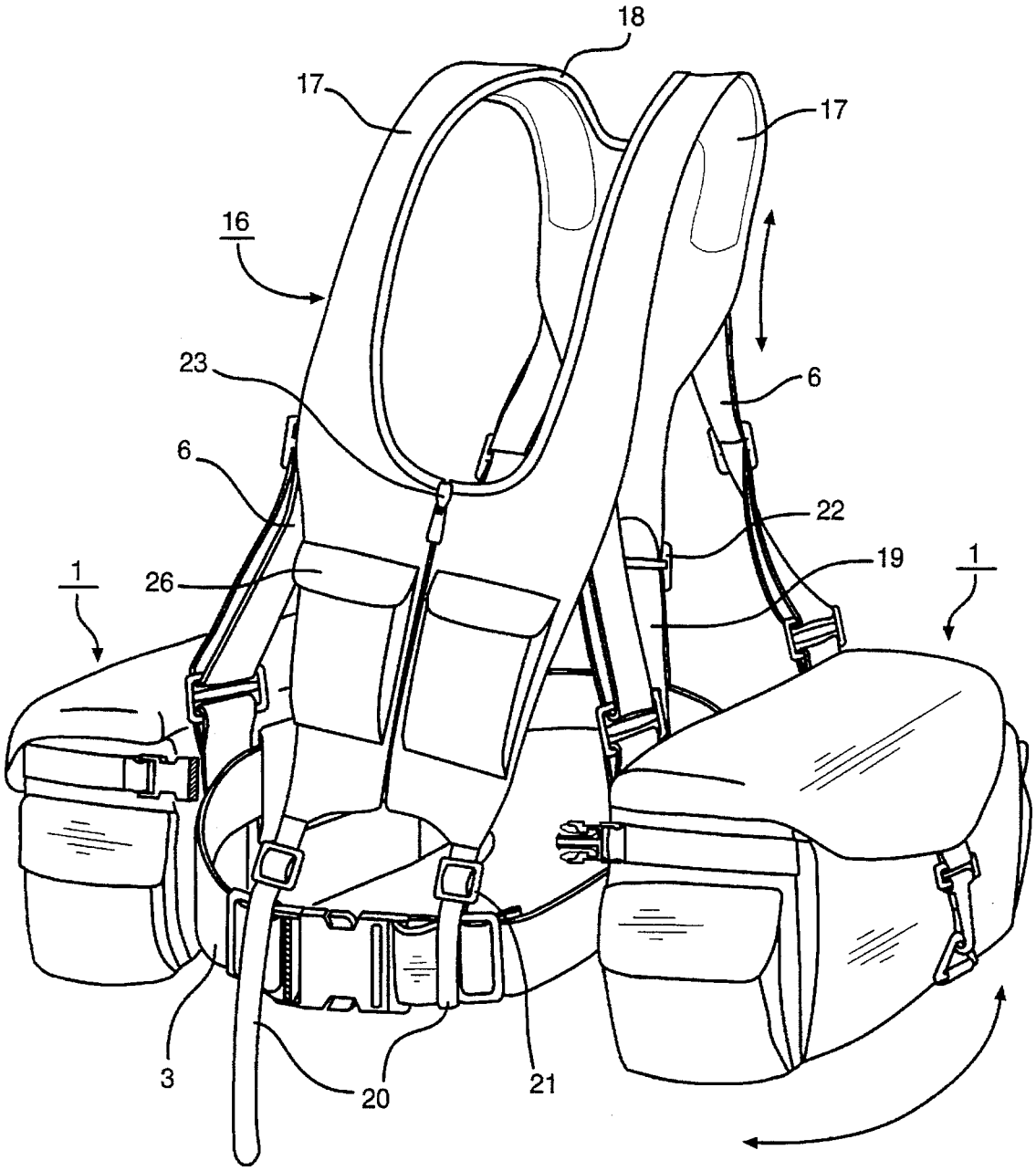
FIG. 4, shows a front perspective view of the carrying system of FIG. 1, with the omission of the adjustable upper back flexible binding and the attachment of the optional shoulder strap support vest.
Figure 5:
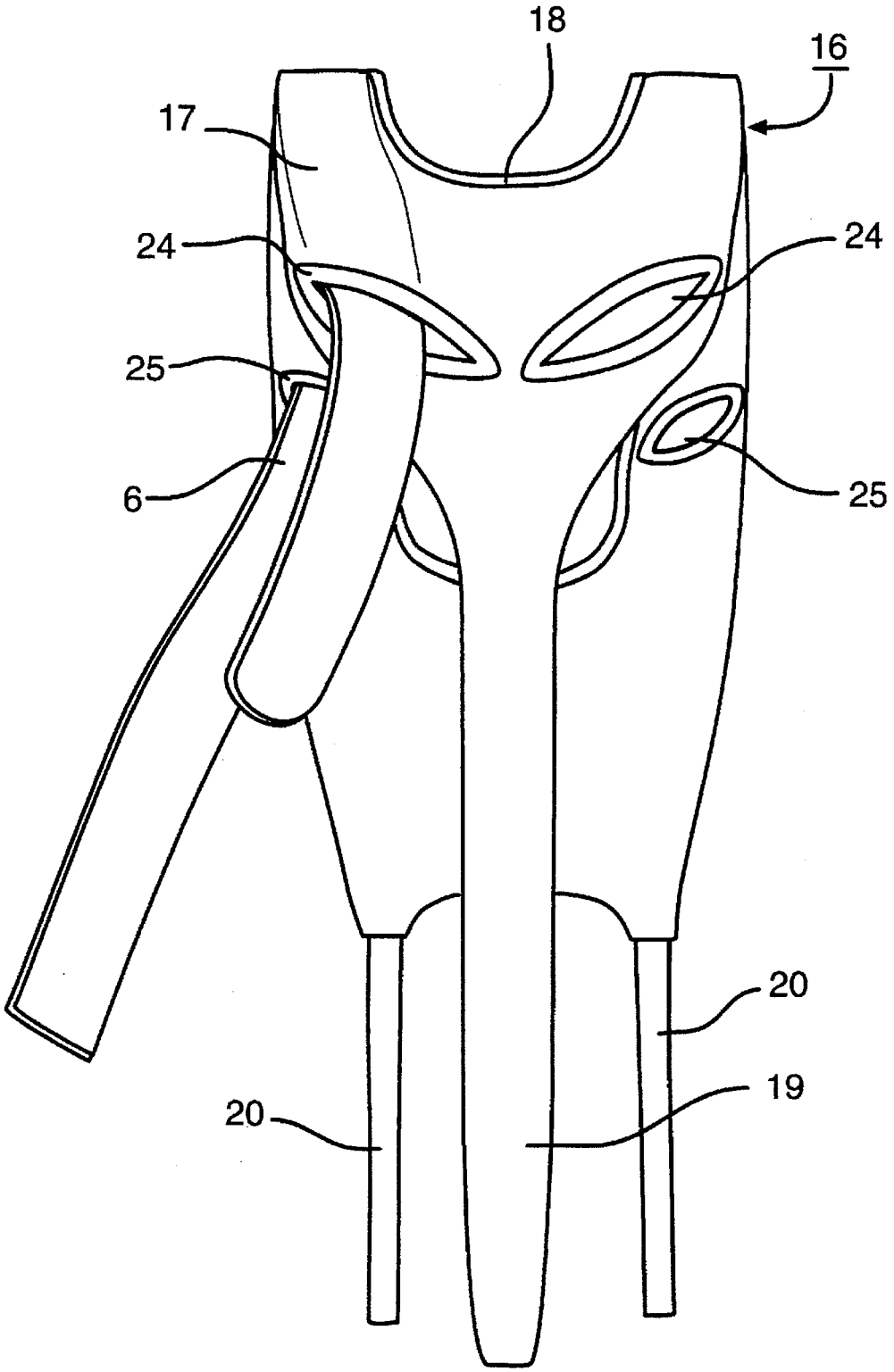
FIG. 5, shows a rear view of the shoulder strap support vest and the port openings used to channel the shoulder straps through the vest.

Referring now to FIG. 4, the carrying system may omit the use of the adjustable upper back flexible binding 15 and use the optional shoulder strap support vest 16. The shoulder strap support vest 16 is constructed of light-weight natural or synthetic cloth and is provided with shoulder strap channels 17 that guide each adjustable webbing shoulder strap 6 over the wearer's shoulders and to the wearer's upper back. Referring now to FIG. 5, the rear view of the shoulder strap support vest 16, shoulder strap channel port openings under the breast 25 and port openings out over the upper back 24, guide the webbing shoulder straps through the shoulder strap channels 17. Cloth bias tape 18 is provided to seal the seam of the inner and outer layers of the shoulder strap support vest 16 and the port openings 24 and 25 of the shoulder strap channels 17.

Referring again to FIG. 4, the shoulder strap channels 17 are provided to position the shoulder straps 6 around the wearer's body while permitting the shoulder straps 6 to move freely within the shoulder strap support vest 16. As the position of each compartment bag 1 is changed around the webbing waist belt 3, the shoulder straps 6 are free to adjust within the shoulder strap channels 17, thereby eliminating any restriction of compartment bag 1 adjustment.

To further attach the shoulder strap support vest to the carrying system, the approximate two-inch tail strap 19 (referring to FIG. 4 and FIG. 5) is wrapped around the webbing waist belt and adjusted and secured with a two-inch standard triglide 22. Approximate three-quarter-inch webbing straps 20 are sewn into the front left and right bottom sides of the shoulder strap support vest, wrapped around the webbing waist belt, adjusted and secured with three-quarter-inch triglides 21, like those sold under the trademark ITW NEXUS. A standard open garment zipper 23 is provided at the front of the shoulder strap support vest to join the left and right sides. Pockets 26 may also be provided to both front sides of the shoulder strap support vest 16 to furnish additional carrying space.

While the present invention has been disclosed in terms of the preferred embodiment in order to facilitate better understanding thereof, it should be appreciated that the invention can be embodied in various ways without departing from the principal of the invention. For example, alternative compartment bag shapes and sizes may be employed to facilitate needs for carrying different types or differing amounts of equipment. Though the preferred embodiment discloses the use of acetal side-release buckles, triglides, hook and loop material, zippers, other such closing means may also be advantageously utilized. Furthermore, the adjustable shoulder straps may be attached at the sides rather than the rear of each compartment bag. Therefore, the invention should be understood to include all possible embodiments and modifications to the shown embodiments which can be embodied without departing from the principals of the invention as set forth in the appended claims.

I claim:

1. A carrying system comprising: two similar compartment bags; a belt loop attached to one said side of each compartment bag; an adjustable belt passing through each compartment bag belt loop; a pair of adjustable shoulder straps each having distal ends attached to opposite sides of each compartment bag, respectively; and an adjustable flexible binding slidably mounted to said shoulder straps to position the adjustable shoulder straps together adjacent the upper back of a user when worn over the user's shoulders.

2. The carrying system of claim 1 further comprising fasteners attached to opposite sides of each compartment bag whereby each compartment bag is adapted to be fastened together by said fasteners to configure a single shoulder bag.

3. The carrying system of claim 1 wherein said binding comprises a shoulder strap support vest having channel openings therein which are adapted to receive each said adjustable shoulder strap to position said adjustable shoulder straps over said user's shoulders.

4. The carrying system of claim 1 further comprising at least one compartment partition releasably attached to the inside of each compartment bag to partition each compartment and maintain bag shape integrity.

* * * * *